United States Patent [19]

Asami

[11] 4,123,892

[45] Nov. 7, 1978

[54] COIN PACKAGING MACHINE

[75] Inventor: Kazuto Asami, Himeji, Japan

[73] Assignee: Glory Kogyo Kabushiki Kaisha, Himeji, Japan

[21] Appl. No.: 731,822

[22] Filed: Oct. 12, 1976

[30] Foreign Application Priority Data

Oct. 9, 1975 [JP] Japan ..... 51-121920

[51] Int. Cl.[2] ..... B65B 57/10

[52] U.S. Cl. ..... 53/54; 133/1 A; 133/8 A; 53/493; 53/212

[58] Field of Search ..... 133/1 R, 1 A, 8 R, 8 A, 133/8 D; 53/54, 212, 59 R

[56] References Cited

U.S. PATENT DOCUMENTS

| | | | |
|---|---|---|---|
| 1,901,715 | 3/1933 | Young | 133/8 R X |
| 3,821,917 | 7/1974 | Hatanaka | 53/212 X |

*Primary Examiner*—Joseph J. Rolla

[57] ABSTRACT

A coin packaging machine for packaging a predetermined number of coins has a denomination selecting section for selecting a denomination of coins, a packaging section for packaging stacked coins in a paper wrapper, a conveyor for conveying coins to the packaging section, and a counting section for counting the number of coins conveyed. Upon selection of a new denomination, the coins of the previously selected denomination left in the packaging section are removed, and packaging of coins of the newly selected denomination is automatically started.

4 Claims, 9 Drawing Figures

40
n1 n2 n3 n4
44
K2
K1
K3
K9
CAM
41
42(42A~42C)
52
COINCIDENT DETECTION
OPERATION CONTROL INPUT MEANS
75
46(46A~46C)
K4
K5
K7
K6
K8
50
53
48
CLUTCH
DDC
MAIN CONTROL CIRCUIT
M5
76
77
M4
M1
78
CONTROL DEVICE
M2
36
81
80
KDC
M3
79
PACKAGING CONTROL DEVICE
M6
37
83
82
HDC
a
b
c
d
e
f
g
h
i
j
k
l
m

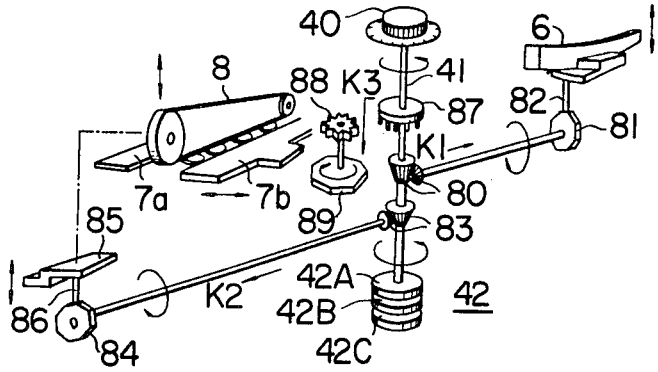
FIG. 2
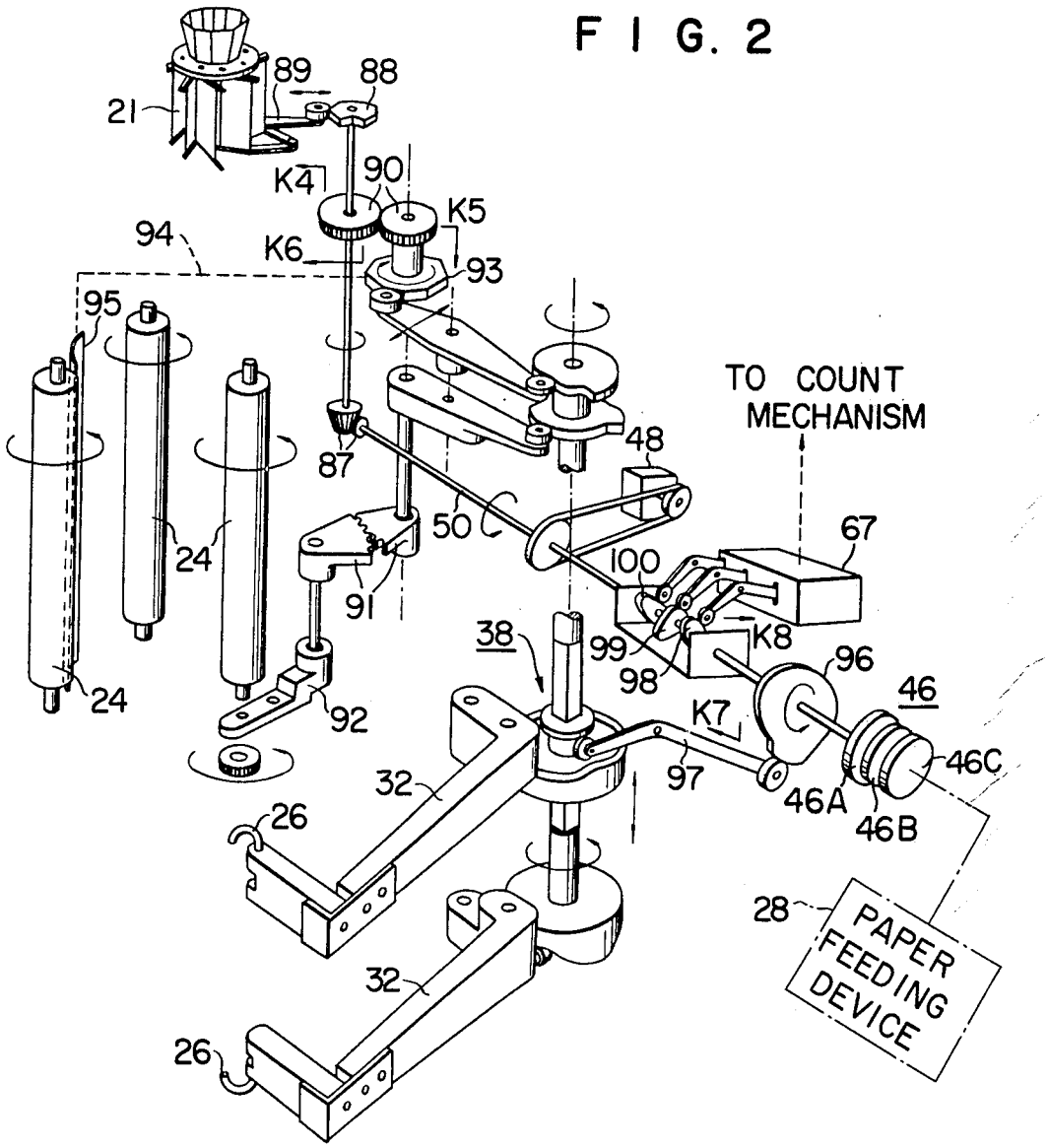

STW
RWH
M6(37)
INR
PUS
AD4
AD5
NO11
I22
NO13
FF3
R3
R2
NO14
C15
PG1
SW5
SW6
I20
C13
C14
I21
NO15
NO17
ALB
STH
SW7
NO16
FF4
I23
AD6
TM1
NO19
NO18
I24
ALL
SX6
WRC
STL
NO12
AD7
TM2
I28
EX4
ALA
STP
TMR
ND19
NO20
R5
I30
CLE
R4
I29
C16
PG2
I31
I27
SW8
I25
R6
CLW
PB2
MM2
ND18
NO21
CLR
C17
C18
I26
C19
FF5
R7
C20
SHT
NO22
MM3
TUB
SWS
WRH
I47
SDS
AD17
NO23
I48
I34
NO20
I44
ND23
SW9
C21
C22
I32
ND21
NO24
M5(76)
I45
I33
AD18
ND22
C23
I46
DDC
SW10
C25
KX3
I36
I35
EX1
I41
ND24
ND25
AD8
I49
X3
SET
RES
EX2
I42
I37
C26
I43
NO25
SCS
K42A
K42B
K42C
42
C24
I38
I39
EX3
MSA
C27
C28
C29
I40
52
MSB
HSC
R8
C30
K46A
K46B
K46C
46
I50
MM4
NO28
I51
SND
NO26
FF6
NO27

COIN PACKAGING MACHINE

BACKGROUND OF THE INVENTION

This invention relates to coin packaging machines for packaging a predetermined number of coins of one denomination from among coins of different denominations, and more particularly to coin packaging machines in which when a preselected kind of package is changed to another one, coins of the previously designated denomination but which are no longer desired are removed from the packaging section and the machines are made ready for packaging coins corresponding to the newly designated kind of package.

If previously designated and now undesired coins the denomination of which is different from the denomination of coins to be packaged (hereinafter referred to as "undesired coins" when applicable) are left in the packaging section of a coin packaging machine of this type, they may cause troubles in the machine. Therefore, it is necessary to safely and positively remove the undesired coins before the packaging operation of the newly designated denomination is carried out. Furthermore, it is desirable for the efficient use of the machine that the packaging operation is automatically started after the undesired coins have been removed.

SUMMARY OF THE INVENTION

Accordingly, an object of this invention is to provide a coin packaging machine which fullfils the above-described requirements.

More specifically, an object of the invention is to provide a coin packaging machine in which undesired coins are positively removed before a coin packaging operation is carried out, and the coin packaging operation is automatically started after the undesired coins have been removed.

The foregoing object and other objects of the invention have been achieved by the provision of a coin packaging machine for packaging a preselected number of coins separately according to the denominations thereof which comprises kind of package selecting means for selectively specifying a kind of package of coins to be packaged, i.e. a number of coins and a denomination for the coins, packaging means for packaging coins stacked in a stacking cylinder with packaging paper fed by a paper feeding section, coin conveying means for conveying coins to said stacking cylinder, and coin counting means for counting the number of coins conveyed by said coin conveying means, and in which when the kind of package is changed to another kind of package by said kind of package selecting means, the undesired coins left in said packaging means are removed, and coins for the newly selected kind of package selected by said kind of package selecting means are automatically packaged.

The novel features believed characteristic of this invention are set forth in the appended claims. This invention itself as well as advantages thereof will be best understood from the following detailed description of illustrative embodiments, when read in conjunction with the accompanying drawings.

BRIEF DESCRIPTION OF THE DRAWINGS

In the accompanying drawings:

FIG. 2 is an explanatory diagram showing essential parts of the coin packaging machine;

DETAILED DESCRIPTION OF THE INVENTION

Figure 1A:
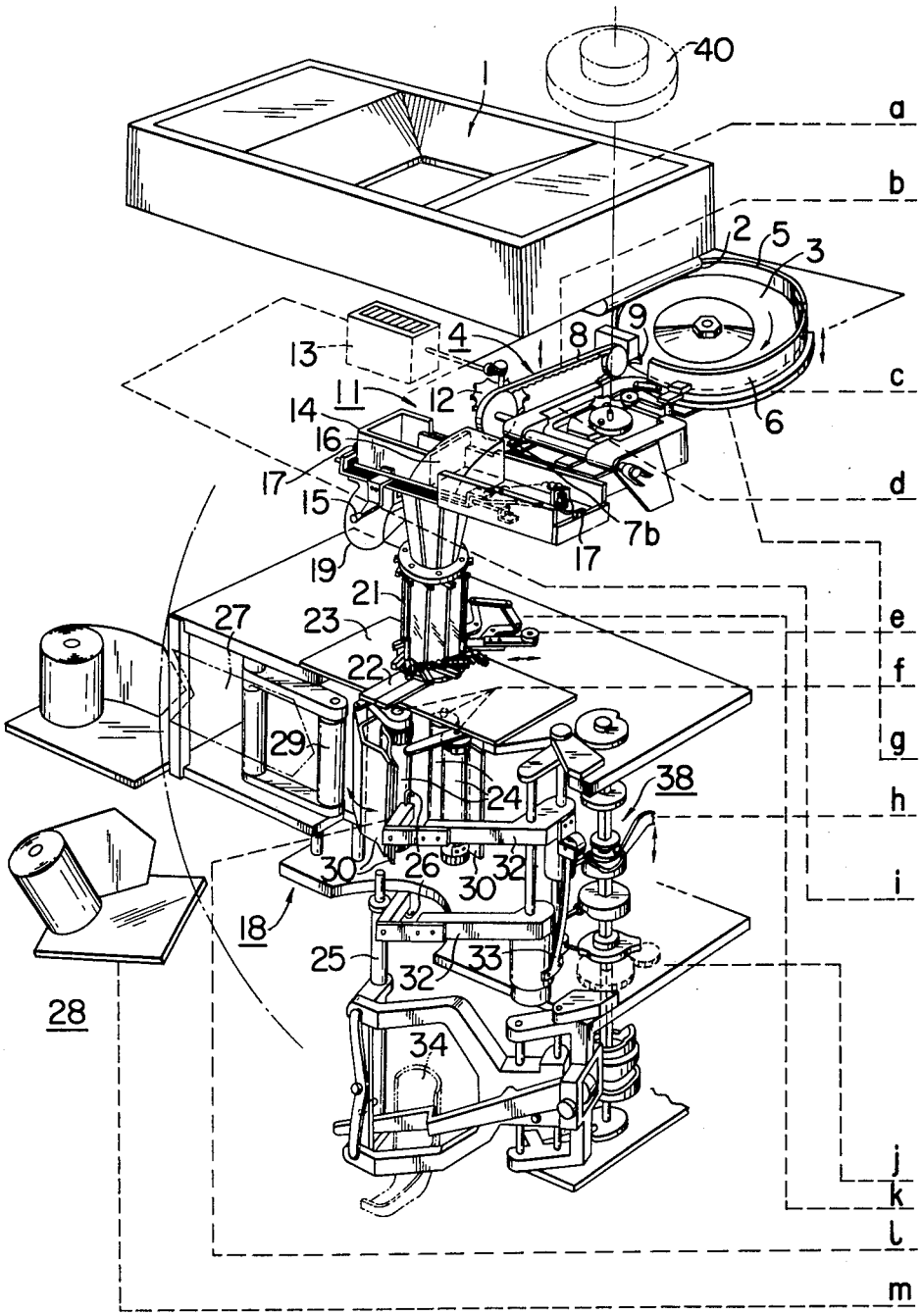
FIGS. 1A and 1B are two parts of a diagram illustrating the mechanism of a coin packaging machine according to this invention.
Figure 1B:
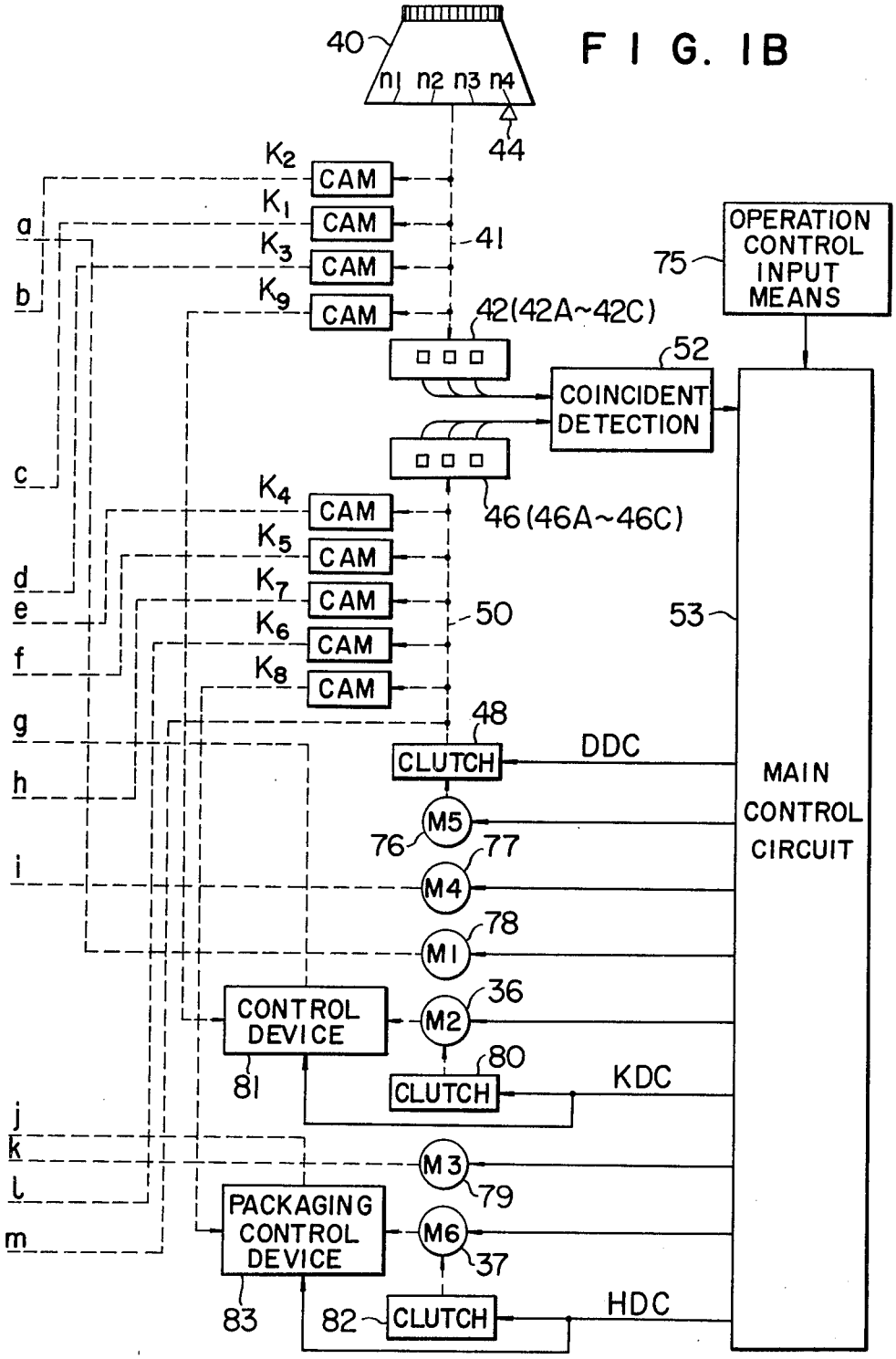

A coin packaging machine to which this invention can be applied is shown in FIGS. 1A, 1B and 2, comprises a packaging mechanism and a counting mechanism for introducing a predetermined number of coins into the packaging mechanism.

In this machine, coins to be packaged are introduced by means of a belt conveyer 2 onto a rotary disk 3 from a hopper 1 forming the coin receiving section of the counting mechanism. The coins thus introduced are aligned on the circumferential part of the rotary disk 3 by centrifugal force. The coins thus aligned are successively, or one by one, introduced into a coin path 4. A stationary side wall 5 is provided so as to occupy approximately a half of the circumference of the rotary disk 3. A thickness control plate 6 is provided ahead of the coin path 4 and adjacent to one end of the side wall 5 so that there is provided a gap between the thickness control plate 6 and the upper surface of the rotary disk 3, the gap corresponding to the thickness of one coin. Thus, the coins are aligned and delivered toward the coin path 4 one by one.

More specifically, the thickness control plate 6 is provided on the inner surface of a cover (not shown) which covers the rotary disk 3 and the area around it in such a manner that the plate 6 is vertically movable. The thickness control plate 6 is pressed toward the rotary disk 3 by a spring, but the vertical position of the thickness control plate 6 can be controlled against the elasticity of the spring by a height control means (not shown) confronting the lower surface of the rotary disk 3.

The coin path 4 is made up of a stationary guide plate *7a* and a movable guide plate *7b* each having an "L"-shaped section, and a rake-out belt 8 extending along the gap between the two guide plates *7a* and *7b*. The guide plates *7a* and *7b* extend horizontally along the belt 8, confronting each other.

The coins, being supported by the guide plates *7a* and engaged by *7b* and the belt 8, are raked out one by one. The guide plate *7b* can be moved in the direction of its width. Coins having diameters smaller than the distance between the guide plates *7a* and *7b* are selectively rejected through the gap therebetween. A fixed pawl 9 is provided at the entrance of the coin path 4 to receive the coins arranged in a line on the rotary disk 3. The end portion of the movable guide plate *7b* near the rotary disk 3 is opposed to the fixed pawl 9 so as to provide a gate therebetween. Accordingly, coins having diameters larger than the width of the gate cannot be taken into the coin path 4.

A counting section 11 is provided at the exit of the coin path 4. The star-wheel 12 of the counting section is turned by coins raked out of the coin path 4, whereby whenever a coin is raked out a count signal is introduced into a counter 13 to count the number of coins.

The coin passed through the counting section 11 is fed into a mode change-over section 14 which comprises a change-over mechanism 16 (slidable right and left) for changing over the path of coins by a change-over knob 15, and a mode change-over switch 17 for providing an electrical mode change-over signal corresponding to a change-over position of the change-over mechanism 16. When the change-over mechanism 16 is switched over to a packaging mode position, coins are delivered to a packaging section 18 which is a part of the packaging mechanism, but when the change-over mechanism 16 is switched over to a count mode position, coins are fed to a counted-coin discharging outlet 19.

The packaging section 18 comprises: a coin stacking mechanism 23 having a stacking cylinder 21, a shutter 22, and a vibrating mechanism; three packaging rolls 24 with a drive mechanism; a guide rod 25 with a drive mechanism; and crimping hooks 26 with a drive mechanism.

The stacking cylinder 21 is a polygonal cylinder formed by arranging a plurality of plate members in overlapping relation to each other. The coins successively passed through the change-over mechanism 16 are stacked on the shutter 22, which is adapted to openably close the lower end of the stacking cylinder 21, one by one with the aid of the vibration of the vibrating mechanism. When the plate members of the stacking cylinder 21 are driven, they are moved radially inwardly or outwardly so that the inside diameter of the stacking cylinder is adjusted so as to be slightly larger than the outside diameter of the coins.

When a predetermined number of coins have been stacked in the stacking cylinder 21, the coins thus stacked are brought between the packaging rolls 24 immediately below the stacking cylinder 21 by the guide rod 25. The guide rod 25 is raised along the axis of the stacking cylinder 21 to the position of the shutter, and when the shutter 22 is opened the stacked coins are loaded on the top of the guide roller 25, and then the guide roller is moved downward.

The three packaging rolls 24 are arranged symmetrically with respect to the axis of the stacking cylinder 21, two of the rolls 24 in front of the axis of the stacking cylinder 21, and the third one at the rear of the same. These rolls 24 are so designed as to approach one another and to move away from one another keeping this symmetrical condition at all times. Thus, the rolls 24 rotate the stacked coins moved downward by the guide rod 25 by contacting the side surface of the stacked coins. In this example, the rolls 24 have three positions: a standby position where the rolls are remote from the axis of the stacking cylinder, a first position where they approach the side surface of the stacked coins, and a second position where they rotate the stacked coins by contacting the side surface thereof. While the guide rod 25 guides the stacked coins downward, the rolls advance to the first position so as to keep the stacked coins in the stock, and further advance to the second position so as to wrap the stacked coins with packaging paper.

When the packaging rollers 24 have moved to the second position, packaging paper 27 corresponding to a preselected monetary denomination is introduced through paper feeding rolls 29 from a paper feeding device 28. The packaging paper 27 thus introduced is guided by packaging paper guide plates 30 extended between the packaging rolls 24, and is conveyed between the packaging rollers 24 and the stacked coins. Finally, the packaging paper 27 is wrapped on the stacked coins.

When the paper wrapping operation has been completed, the packaging paper guide plate 30 between the two rolls 24 positioned in front of the axis of the stacking cylinder is moved forward to move away from its position between the two rolls 24. On the other hand, the other packaging paper guide plates 30 are so designed as to move forward and backward together with the three rolls 24.

The crimping hooks 26 are connected to the ends of a pair of arms 32 which are vertically spaced from each other. Upon completion of the packaging sheet wrapping operation, the arms 32 are moved backward. As a result, the crimping hooks 26 are moved toward the axis through the space between the rolls 24, whereby both lateral edge portions of the packaging paper 27 are folded inwardly. Thereafter, the arms 32 are vertically shifted so as to approach each other, as a result of which the folded lateral edge portions are crimped. After this operation, the arms 32 are moved forward to return to their original positions. A spring 33 is interposed between the arms 32 so that the arms are biased toward each other.

After the packaging of the stack of coins is thus completed, the packaging rolls 24 return to the standby position, and the guide rod 25 is moved outwardly, whereby the package of coins drops into a packaged coin discharging outlet 34.

The conveyer 2 between the hopper 1 and the rotary disk 3 is driven by a coin feeding motor 78 (M1). The rotary disk 3 is driven by a rotary disk motor 36 (M2), and drives the belt 8 through a clutch 80 and a rake-out belt control device 81. The stacking cylinder 31 is driven by a vibrating motor 79 (M3). The counter 13 is reset by a clear motor 77 (M4). The paper feeding device is moved through a clutch 48 by a paper feeding motor 76(M5). The position of the paper feeding device 28 thus moved is detected by cam switch means 46 comprising three cam switches 46A, 46B and 46C. The diameter of the stacking cylinder 21 is set by a cylinder diameter setting cam K4 mounted on the rotary shaft 50. The position of the packaging rolls 24 is set by a roll position setting cam K5 in correspondence to a preselected coin denomination. Furthermore, the degree of opening off the packaging paper guide plates 30 is set by a guide roll setting cam $K_6$ in accordance with the preselected coin denomination, and the range of shifting of the crimping hooks 26 is set by a crimping hook setting cam $K_7$.

On the other hand, a packaging motor 37 (M6) drives a packaging control device 83 through a speed change cam $K_8$ provided on the rotary shaft 50 and a clutch 82 thereby to turn a train of packaging cams. Thus, the opening and closing operation of the shutter 22, the operation of the packaging rolls 24, the opening and closing operation of the packaging paper guide plates 30, the vertical movement and turning operation off the guide rod 25, and the shifting and turning operations of the arms 32 with the crimping hooks are synchronously carried out.

When packaging coins of different denominations, since these coins are different in diameter and thickness, it is necessary to preset the distance between the rotary disk 3 and the lower surface of the thickness control plate 6, the width of the coin path 4, the height of the rake-out belt 8 with respect to the guide plates 7*a* and 7*b*, the inside diameter of the stacking cylinder 21, the positions of the packaging paper guide plates 30 with respect to the stacked coins, the distance between the crimping hooks 26 (or the height of the upper arm 32), and the position of the paper feeding device 28, according to the kind of package, i.e. the denomination of the coins and the number of the coins so that all of these elements are suitably operated.

For this purpose, there is provided a kind of package setting device which in the disclosed embodiment, has a manually operated denomination selecting knob 40 employed as denomination selecting means. This knob 40 is mounted on a rotary shaft 41 on which a thickness control cam K1, a rake-out belt setting cam K2, a coin path width setting cam K3, and a speed change cam K9 are mounted. One end of the rotary shaft 41 is coupled to denomination-selection-output cam switch means 42 made up of, for instance, three cam switches 42A, 42B and 42C, which is adapted to function as electrical denomination selection output means.

With this cam switch means 42, the number of denominations which can be selected thereby is $2^3$ (=8) in this embodiment. The knob 40 is marked with denomination scales $n_1$, $n_2 \ldots n_8$ at the periphery thereof. A desired denomination is selected by setting a reference scale 44 to the respective denomination scale, as a result of which a denomination selection output is delivered from the cam switch means 42.

Similarly as in the cam switch means 42, cam switch means 46 made up of three cam switches 46A – 46C is provided for obtaining setting outputs from the abovedescribed denomination selection output. This cam switch means 46 is coupled to one end of a rotary shaft 50 the other end of which is connected to the output shaft 47 of the paper feeding motor 76 through the clutch 48 and through a gear mechanism 49. When the shaft 50 is rotated by the paper feeding motor 76, an electrical setting output corresponding to the angular position of the shaft is produced by the cam switch means 46.

The outputs from the cam switch means 42 and 46 are applied to a coincidence detection circuit 52, which upon coincidence of these outputs, produces a coincidence output. The coincidence output thus produced is inputted to a main control circuit 53.

The main control circuit 53 controls the motors M1 – M6 and the clutches 48, 80 and 92 according to the coincidence output and the output of operation condition input means 75.

Thus, if, when the denomination selecting knob 40 is set to one denomination scale (for instance $n_1$), the angular position of the shaft 50 corresponds to another denomination scale (for instance, $n_4$), the setting output of the cam switch means 46 does not coincide with the denomination selection point of the cam switch means 42, and therefore no concidence output is provided by the coincidence detection circuit 52. Accordingly, the clutch 48 is operated by the main control circuit 53, and the rotary shaft 50 is turned by the paper feeding motor 76 (M5) until a coincidence output is produced by the coincidence detection circuit 52. That is, the shaft 50 is positioned at its angular position corresponding to the denomination selected by the denomination selecting knob 40, whereupon a mechanical setting output having magnitude corresponding to the angular position of the shaft 50 is obtained to set the various elements described above.

The thickness control cam K1 moves vertically and sets an adjuster 56 provided below the cam K1 with the aid of a cam plate 55 turned by a bevel gear 54 connected to the rotary shaft 41. Similarly, the rake-out belt setting cam K2 moves vertically and sets an adjuster 86 provided below the stand 85 of the rake-out belt 8 with the aid of a cam plate 84 turned by a bevel gear 57.

The coin path width setting cam K3 operates to turn a cam plate 89 in contact with the movable guide plate **7*b* with the aid of a star-wheel engaging a crown gear 87 mounted on the rotary shaft 41, thereby to horizontally move and set the guide plate 7*b*** so that the width of the coin path corresponds to the diameter of the coins having the preselected demonimation.

Thus, when coins having the same denomination as that preselected are introduced onto the rotary disk 3, the thickness control plate 6 operates to positively arrange them in the coil path 4 one by one, and the rake-out belt 8 operates to rake out the coins along the guide plates **7*a* and 7*b* with optimum abutting force. In the case when a coin having a denomination different from the preselected one is delivered to the rotary disk 3, if the coin is greater in thickness than a coin having the preselected denomination (hereinafter referred to as "a predetermined coin" when applicable), it is rejected by the thickness control plate 6; and if the diameter of the coin thus introduced is smaller than the predetermined coin (it is, usually thinner than the predetermined coin), it drops through the gap between the guide plates 7*a* and 7*b*. Thus, even if coins different in denomination from the predetermined coins are put in the hopper 1, or even if coins of the predetermined denomination and other coins are put together in the hopper 1**, the coins other than the coins of the predetermined denomination will never be packaged.

The cylinder diameter setting cam K4 operates to move and set a control lever 89 of the stacking cylinder 21 by the use of a cam plate 88 turned through a bevel gear 87 mounted on the rotary shaft 50. Therefore, even if a coin drops into the stacking cylinder 21 in such a manner that the surfaces of the coin are in parallel with a vertical plane, it is eventually horizontally positioned therein because it is vibrated when dropped. Therefore, the coins dropped into the stacking cylinder 21 are positively stacked.

The roll position setting cam K5 operates to turn a lever 92 which supports the packaging roll 24 through a bevel gear 87 and a gear mechanisms 90 and 91 so that when a stack of coins is lowered into the space surrounded by the packaging rolls 24, there is a slight gap between the side surface of the stack of coins and the packaging rollers 24, that is, the first position of the packaging rollers 24 is set according to the outside diameter of the coin stack. Thus, the rolls 24 serve as guide walls for the coin stack when it is lowered by the guide rod 25 into the space surrounded by the rolls 24, and therefore the stack of coins can be kept as it is.

The guide roller setting cam K6 operates to determine the closure position of the packaging paper guide plates 30 according to the diameter of the coins of a predetermined denomination so that the packaging paper 27 is positively wrapped around the stack of coins with the aid of the packaging rolls 24 when the packaging paper guide plates 30 has taken the closure position. More specifically, similarily as in the case of the cam K4, the guide roller setting cam K6 operates to turn with respect to the packaging roll 24 (on the left side in this embodiment) the packaging paper guide plate 95, which is provided for the packaging roll 24, through a link mechanism 94 with the aid of a cam plate 93 turned by the bevel gear 87 and the gear mechanism 90, and determines the direction of the guide plate 95 so that when the packaging rollers reach the first position, the inner surface of the guide plate 95 is substantially along the outside surface of the stack of coins.

The crimping hook setting cam K7 operates to position the upper shift arm 32 so that when the stack of coins is brought to the lowest level by the guide rod 25, the upper crimping hook 26 is at a level higher than the height of the stack of coins which is determined by the total thickness of the coins having the preselected denomination. More specifically, the cam K7 operates to vertically swing a lever 97 with the aid of a cam plate 96 mounted on the rotary shaft 50, the lever 97 engaging the upper shift arm at its one end, as a result of which the arm 97 and a timing cam provided therefor are vertically moved and set.

Therefore, the crimping hooks 26 can positively fold and crimp the both lateral edge portions of the paper 27 wrapped around the stack of coins.

If the speeds of the rotary disk 3 and the rakeout belt 8 are maintained unchanged, when the coins arranged on the rotary disk 3 under the thickness control plate 6 are raked out, the number of coins raked out for a unitary period of time is decreased the greater the diameter of the coin. Therefore, in order to stack a predetermined number of coins in the stacking cylinder 21 in the same period of time at all times regardless of the diameters of the coins, it is necessary to change the speeds of the above-described rotary disk 3 and belt 8. Furthermore, when the packaging rollers 24 are rotatably in contact with the stack of coins to wrap the packaging paper around it, in order to complete the wrapping operation in the same period of time for all coin diameters it is necessary to keep the circumferential speed of the stack of coins unchanged regardless of the diameter thereof. For this purpose, a speed change mechanism is coupled through a speed change cam K8 to the drive output shaft 50 of the paper feeding device 28. Therefore, when the shaft 50 is turned in correspondence with the preselected monetary denomination, this operation is transmitted to the cam K8, whereby the speed of the packaging motor M6 is changed by the speed change mechanism.

Condition signals from a power switch, means for setting the number of coins, a start button, a stop button, and a clear button which will be described later, the above-described mode change-over switch, and the operation condition input means 75 are connected to the main control circuit 53, whereby the main control circuit 53 controls the whole operation of the coin packaging machine.

A speed change cam K9 comprises a high speed cam plate 98, a middle speed cam plate 99, and a low speed cam plate 100 which are fastened to the rotary shaft 50. With these cam plates are engaged the operating levers of the speed change mechanism 67 provided for the packaging rolls 24 and the paper feeding rolls. The speed change cam K8 (not shown) is the same as the speed change cam K9.

Figure 3:
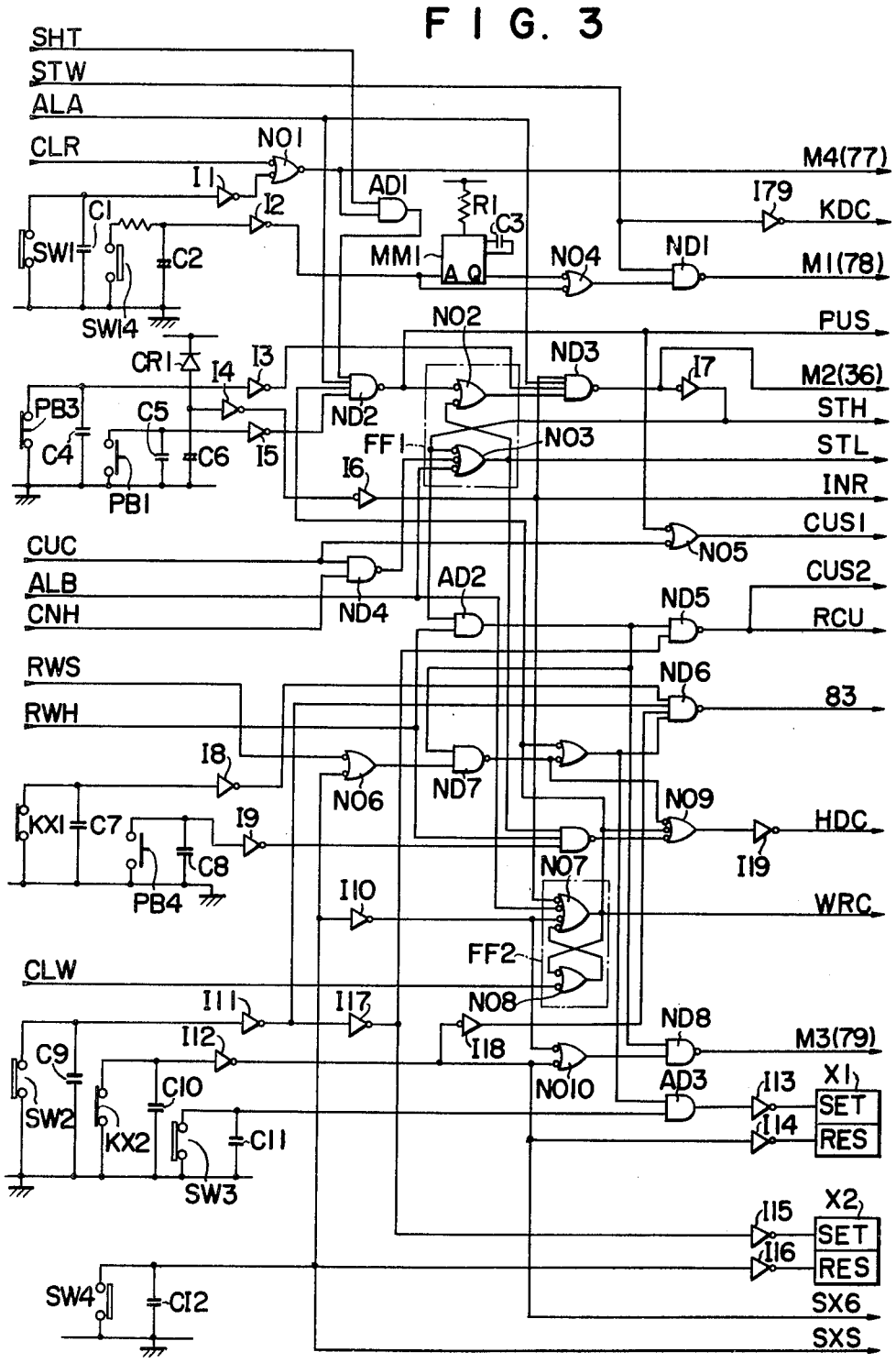
FIGS. 3, 4 and 5 are three parts of a circuit diagram showing the control system of the coin packaging machine.
Figure 4:
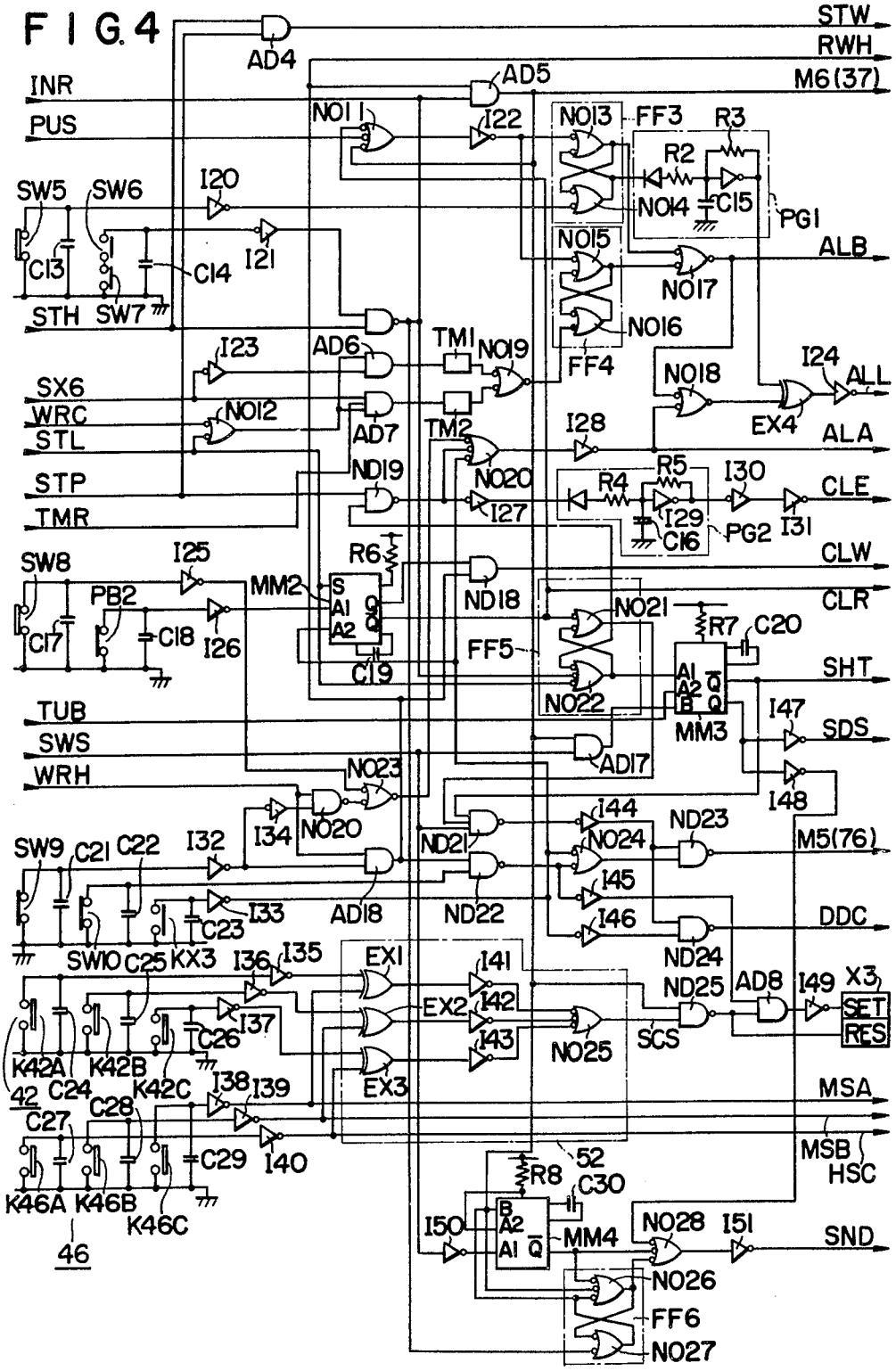
Figure 5:
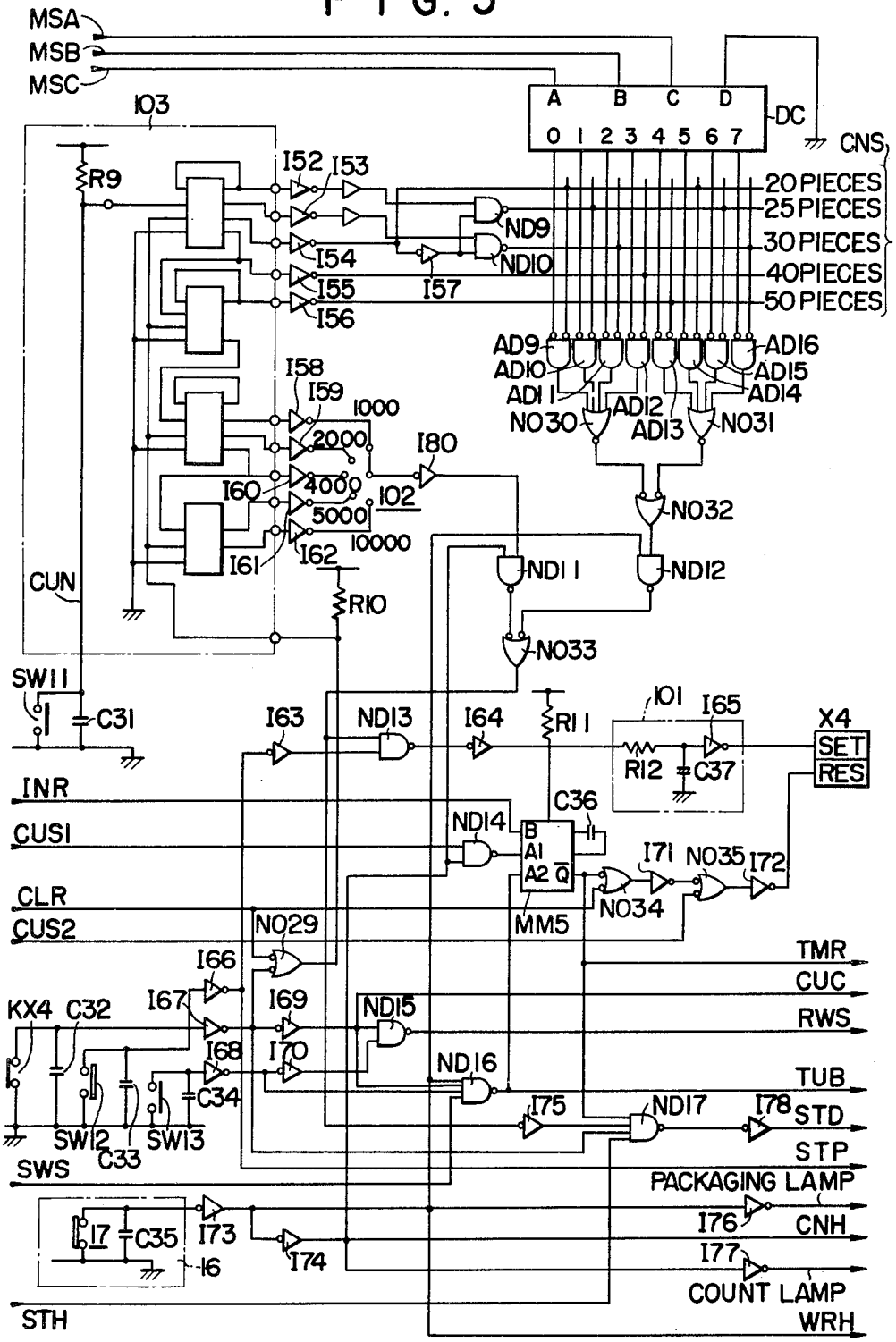
Figure 6:
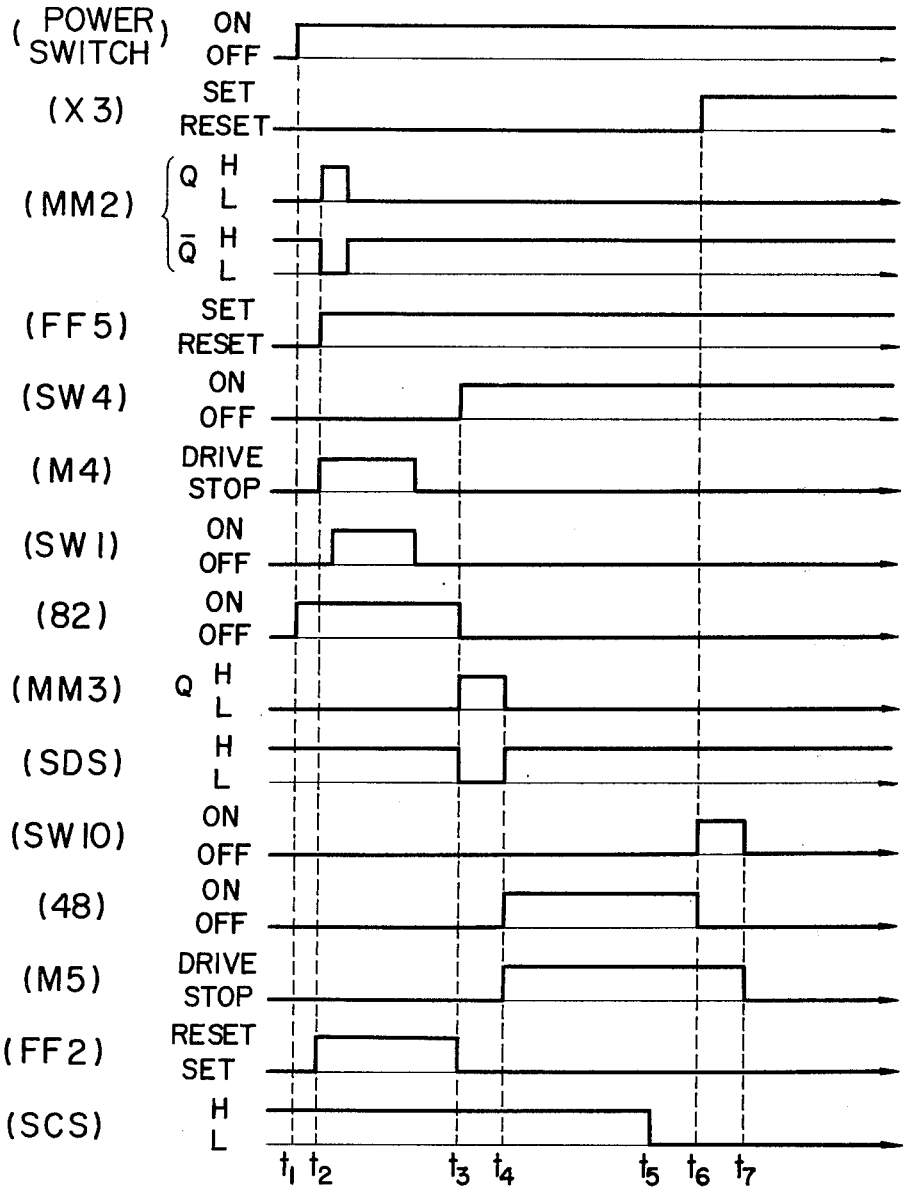
FIGS. 6 and 7 are time charts for a description of the control system.
Figure 7:
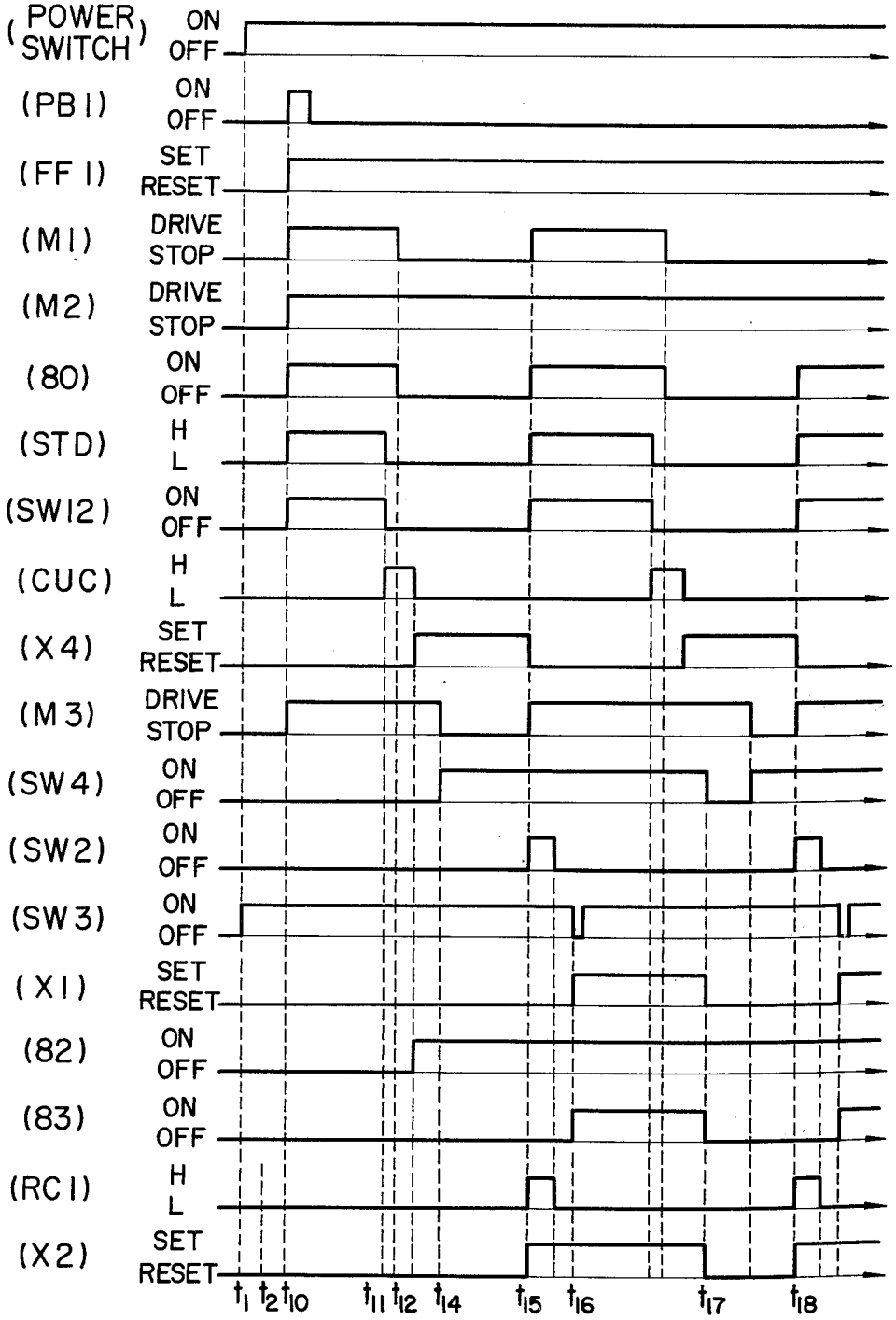

The control circuit for the coin packaging machine thus organized is illustrated in FIGS. 3, 4 and 5. The operation of the control circuit will be described in reference also to time charts indicated in FIGS. 6 and 7.

When the power switch of the coin packaging machine is turned on at the time instant $t_1$, an initial reset signal INR ("H" level) for resetting the initial conditions is formed by a diode CR1, a capacitor C6, and inverters I4 and I6, and at the time instant $t_2$ immediately after the power switch has been turned on a flip-flop FF2 is reset to produce a packaging clear signal WRC, while a flip-flop FF5 is set. On the other hand, the "Q" output of a mono-multiplier MM2 is set at an "H" level, and the clear motor M4 is driven through a NAND circuit ND18 and a NOR circuit NO1, whereby the counter 13 is cleared. Furthermore, a mono-multivibrator MM5 is also cleared by the initial reset signal INR. While the initial reset signal INR is being produced, the packaging motor M6 is not driven through an AND circuit AD5. A mono-multivibrator MM1 is so designed that when the terminals B, $A_1$ and $A_2$ are at "H", "L" and "L" levels, respectively, the "Q" output is at an "H" level.

In FIGS. 3, 4 and 5, the contacts are indicated by marks and respectively.

The motor M4 makes one revolution and stops by means of a one-revolution keep switch SW1.

When the mode change-over switch 17 is operated to provide the packaging mode, a packaging lamp is turned on through threshold detecting inverters I73 and I76. The mode change-over switch 17 is operated after the front door (not shown) of the coin packaging machine has been opened, but the front door must be kept closed for safety during the coin packing operation. If the front door is kept closed, a front door switch SW9 is kept on, and an "H" level signal is produced by a threshold detecting inverter I32. As the output (a packaging mode signal WRH) of the inverter 173 is at an "H" level, the output of an AND circuit AD18 becomes an "H" level, an "H" level signal is outputted through the AND circuit AD5, and the packaging motor M6 is driven. However, since the clutch 82 is set so as to be inoperative by a clutch drive signal HDC, no drive power is transmitted to the coin wrapping machine.

When the denomination selecting knob 40 is set to the denomination of coins to be packaged, the cam switches 42A – 42C of the cam switch means 42 are turned, and the outputs developed at the contacts K42A – K42C thereof are applied to EXCLUSIVE OR circuits EX1 – EX3 through inverters I35 – I37, respectively. At the same time, the outputs developed at the contacts K46A – K46C of the cam switches 46A – 46C of the cam switch means 46 connected to the rotary shaft 50 of the paper feeding circuit 28 are also applied to the EXCLUSIVE OR circuits EX1 – EX3 through inverters I38 – I40. According to the on-off positions of these contacts K42A –]K42C and K46A – K46B, BCD signals corresponding to the denominations are provided. When the BCD signals from both cam switch means are coincident with each other, the level of the denomination coincidence signal SCS becomes an "L" level through inverters I41 – I43 and a NOR circuit NO25. In this connection, the outputs of the contacts K46A – K46C are applied to a decoder DC adapted to convert a BCD code into a decimal code.

When the output of the cam switch means 42 is not coincident with that of the cam switch means 46, that is, the selected denomination is not equal to the set output denomination, the level of the denomination coincidence signals SCS is at the "H" level, and a keep relay X3 is reset through a NAND circuit ND24. Thus, the relay contact means KX3 takes an "off" position, and the output level of an inverter I33 becomes an "L" level. This "L" output signal is applied to the NOR circuit NO24, the "H" level output of which is applied to one input terminal of a NAND circuit ND23. Since the packaging section is at a predetermined position, a switch SW4 for detecting that the packaging section is at its predetermined position is off, and a predetermined position switch signal SWS of an "L" level is applied to an AND circuit AD 17, NAND circuits 21 and ND16, and an inverter I50.

As an "L" level signal is applied through the inverter I33 to the terminal $A_2$ of the mono-multivibrator MM2, a pulse having a predetermined pulse width is provided at the "Q" terminal thereof and is inputted to a NAND circuit 18. On the other hand, as an "H" level signal is produced by a NAND circuit ND9, a clear signal CLW (L) is produced by the NAND circuit ND 18.

On the other hand, as the level of the "Q" output of the mono-multivibrator MM2 becomes an "L" level, the flip-flop FF5 is reset to store the clear signal CLW, and this set output is applied to the NAND circuit ND21. The output of a NOR circuit NO22 constituting the flip-flop FF5 is fed to the terminal A of a mono-multivibrator MM3, through the "Q" terminal at which a pulse with a predetermined pulse width is produced. Thus, a shutter opening signal SDS (L) is provided through an inverter I47, and therefore the shutter 22 is opened for the predetermined pulse width ($t_3$). At the same time, the output of the mono-multiplier MM3 is applied through an inverter I48 to a NOR circuit NO2, and a solenoid drive signal SND is provided through an inverter I51. By this solenoid drive signal SND, a solenoid (not shown) disposed at the coin package discharging outlet 34 is driven to move outlet 34 so that the coin package and the undesired coins left in the stacking cylinder 21 fall through outlet 34 and are directed into a suitable container.

After the pulse with the predetermined pulse width has been produced through the terminal Q of the mono-multivibrator MM3, the level of the shutter opening signal SDS is raised to an "H" level ($t_4$), and is applied to the NAND circuit ND21. Therefore, the output level of the NAND circuit ND 21 becomes an "L" level. This "L" level signal is applied through an inverter I44 to the NAND circuits ND23 and ND24, and "L" level signals are produced therefrom. Thus, the clutch 28 is operated, and the paper feeding motor M5 is driven, to move the paper feeding device 28.

As result, the paper feeding device 28 is set at the position corresponding to the preselected denomination, the level of the denonimation coincidence signal SCS becomes an "L" level ($t_5$), and the NAND circuit ND25 provides an "H" level output. At this time, a detection switch SW10 for detecting the predetermined position of the paper feeding device is turned on, the input level of the NAND circuit ND22 is raised to an "H" level, and an "H" level signal is outputted through the NOR circuit NO24 and the NAND circuit 23. The paper feeding device 28 is disconnected from the motor M5 by means of the clutch 48, but it is continuously turned by inertia for a while.

When the switch SW10 is turned off, an "L" level signal is outputted from the NAND ND22, and an "H" level signal is applied to an AND circuit AD8 through an inverter I45. In this case, since the denomination selected by the knob 40 is coincident with the denomination relating to the paper feeding device and so forth, the AND circuit AD8 produces an "H" level signal by receiving an "H" level signal from a NAND circuit ND25, and the keep relay X3 is reset. Thus, the relay contact means KX3 is set "on", and the level of the clutch drive signal DDC is raised to an "H" level through the inverter I33, an inverter I46, and the NAND circuit ND24, to stop the paper feeding device 28 and so forth ($t_7$).

Then, a start button PB1 is depressed ($t_{10}$). Therefore, an "H" level signal is applied through a threshold detecting inverter I5 to a NAND circuit ND2, whereby a flip-flop 1 is reset to store the start command. When the flip-flop 1 has been reset, an "H" level signal is produced by a NOR circuit NO2, and the level of a start signal STH is changed to an "H" level through a NAND circuit ND3 and an inverter 17. On the other hand, the rotary disk motor M2 is driven on the output of the NAND circuit ND3.

As a stop plate for mechanically stopping the star-wheel has not been dropped into the groove thereof, a stop switch is in the "off" state, and the level of the output STW of an AND circuit AD4 is raised to an "H" level through an inverter 66. This output is applied to a NAND circuit ND1 and an inverter I79. By the output of the inverter I79, namely, a clutch drive signal KDC, the clutch 80 is operated, and the coin feeding motor M1 is driven on the output of the NAND circuit ND1 ($t_{10}$).

A level switch SW14 for controlling the supply of coins to the rotary disk 3 from the hopper 1 is provided in the rotary disk 3. When this switch SW14 detects an excessive supply of coins, its contact means is closed, and the mono-multivibrator MM1 is triggered. Thus, an "L" level signal is produced from a NOR circuit NO4 with the delay of a predetermined time. Therefore, an "H" level signal is provided by the NAND circuit ND1, and the driving of the rotary disk motor M1 is suspended ($t_{12}$).

As the packaging section is in the standby state at its predetermined position, the switch SW4 is in the "off" state, and an "L" level signal from an inverter I10 is applied to a NAND circuit ND8 through a NOR circuit NO10. On the other hand, the level of the output of an AND circuit 2 is raised to an "H" level with the aid of the "H" level output of the AND circuit AD9 and the start signal STH from the inverter I7, and is then applied to a NAND circuit ND8. By the "H" level output of the NAND circuit ND8 the vibrating motor M3 is driven ($t_{10}$).

As was described, the coins are arranged along the peripheral force of the rotary disk by centrifugal force, and are conveyed to the packaging section by the conveying mechanisms one by one, and are stacked in the stacking cylinder. During this conveying operation, the coins, being conveyed by the star-wheel 12, are mechanically counted, and the number thereof is counted and displayed by the counter 13. On the other hand, a count switch SW11 is provided which is turned on whenever the star-wheel 12 has made five revolutions, or five coins have been conveyed. A detection signal CUN produced by the count switch SW11 is counted by an electronic counter 103. The counter value of the electronic counter 103 is converted into signals CNS representative of 20, 25, 30, 40 and 50 coins (hereinafter referred to as "a coin number signal CNS", when applicable) by inverters I52 to I57 and NAND circuits ND9 and ND10. The counter 103 is so designed that when a denomination is selected by the knob 40, it is cleared through a NOR circuit NO29 by the Q output of the mono-multivibrator MM2.

The output terminals "0", "1", "2" ..... "7" of the decoder DC are provided in correspondence to monetary denominations, respectively. For instance, the output terminals "0", "1" and "4" are provided for monetary denominations 1-yen, 5-yen, and 100-yen, respectively. The setting of the knob 40 to "100-yen coin" causes only the output terminal "4" to have an "L" level, and the other output terminals "0" - "3", and "5" - "7" to have "H" levels.

As the number of 100-yen coins conveyed is counted by the counter 103, and the coin number signals CNS representative of 20 pieces - 40 pieces are produced, "L" level signals are provided but none of the two inputs of the AND circuits AD9 - AD12, and AD14 - AD15 become "L" levels at the same time. However, when the output of the inverter I56 is lowered to an "L" level, or fifty coins are detected, both inputs of an AND circuit AD13 become "L" levels, and an "H" level signal is applied to NAND circuit ND12 through NOR circuits NO31 and NO32. Since an "H" level signal corresponding to the packaging mode has been applied to the other input of the NAND circuit ND12 by the mode change-over switch 17, therefore the output level of the NAND circuit ND12 becomes an "L" level.

Thus, an "H" level signal is produced by an NOR circuit NO33, and the level of a stop plate drive signal STD becomes an "L" level through an inverter I75, a NAND circuit ND17, and an inverter I78 ($t_{11}$). As a result, the stop plate is dropped into the groove of the star-wheel 12, and the coin conveying operation of the conveying mechanism is temporarily suspended.

At this time, a stop plate switch SW12 is turned off, and an "L" level signal is applied to a NAND circuit ND13 through inverters I66 and I63, and a keep relay X4 is set through an inverter I64 and a delay circuit 101. Thus, the relay contact mean KX4 is turned off, and an "L" level signal is produced from an inverter I67, whereby a counter 100 is cleared through a NOR circuit NO29 ($t_{13}$).

In this operation, an "L" level signal is applied to an inverter I69 also, and an "H" level signal is applied to one imput of a NAND circuit ND15. In this connection, in the case where no a "coin-standing" condition (described later) occurs in the stacking cylinder 21, a coin-standing detection switch SW13 is off, and an "H" signal is applied to the other input of the NAND circuit ND15 through inverters I68 and 170. As a result, an "L" level packaging start signal RWS is produced by the NAND circuit ND15.

This packaging start signal RWS is inputted to a NOR circuit NO6, the level of the clutch drive signal HDC is changed to an "L" level to operate the clutch 82, and the drive power of the packaging motor M6 is transmitted to the packaging section to start the coin packaging operation.

Upon transmission of the drive power to the packaging section, the switch SW4 is turned on ($t_{14}$), and an "L" level signal is applied to the NOR circuit NO6, whereby the packaging section is maintained driven by the packaging start signal RWS.

An automatic count start switch SW2 is turned on ($t_{15}$), and an "H" level signal is provided by an inverter I11. This "H" level signal is provided by an inverter I11. This "H" level signal is applied through inverters I17 and I15 to a keep relay X2 to set the latter.

The "H" signal from the inverter I17 is applied to a NAND circuit ND5 also, and the "L" level output of the NAND circuit ND5 is counted, as the number of rolls of coins, by a roll counter.

When the coins have been made ready to be wrapped in the packaging section, the packaging paper 27 is cut into a predetermined length by a cutter. In this operation, a paper-cutting detection switch SW3 is turned off ($t_{16}$), and a keep relay X1 is set through an AND circuit AD3 and an inverter I13. Therefore, the relay contact means KX1 is turned on, and the packaging control device 83 is driven through an inverter I8 and a NAND circuit ND6. When the stack of coins has been wrapped with the paper, or the wrapping operation has been completed, the switch SW4 is turned off, and the keep relay X2 is reset ($t_{17}$). Therefore, the relay contact means KX2 is turned on, and the keep relay X1 is also reset through inverters I12 and I14 ($t_{17}$).

When the coins have been counted, an "L" level signal is applied to a NOR circuit NO35, and the keep relay X4 is reset through an inverter I72 ($t_{18}$).

In this connection, since the shutter 22 has been closed, the automatic count start switch SW2 is turned on. As a result, the above-described counting operation and packaging operation are carried out again.

Next, the case where the change-over mechanism 16 is changed over to the count mode, or the mode change-over switch 17 is turned off, will be described.

In this case, a count mode signal CNH is provided through inverters I73 and I74, and is applied to a NAND circuit ND4, while a count lamp is turned on by the output of an inverter I77. Then, the front door of the coin packaging machine is opened, a box (or a bag) for receiving the counted coins is provided at a counted coin discharged outlet section 19. In this case, the front door is kept open, and the front door switch SW9 is off.

Then, a knob 102 for setting the number of coins is set to a preselected number (in this example, five total numbers of coins, that is, 1000, 2000, 4000, 5000 and 10000 are provided).

It is assumed that the knob 102 is set to "1000 pieces". In this case, the output of an inverter I58 is applied to a NAND circuit ND11 through an inverter I80.

If the start button PB1 is depressed, similarly as in the case of the above-described packaging mode, coins are conveyed to the packaging section. The number of the coins is mechanically counted and displayed by the counter 13, and is further counted through the count switch SW11 by the counter 103. When 1000 coins have been counted by the counter 103, an "L" level signal is provided from the inverter I58, and an "H" level signal is introduced into the NAND circuit ND11 through the inverter I80. Therefore, the NAND circuit ND11 produces an "L" level signal, and the level of the output of the NOR circuit NO33 is raised to an "H" level. Accordingly, the level of the output of the NAND circuit ND13 is changed to an "L" level, and the keep relay X4 is set through the inverter I64 and the delay circuit 101. Thus, the relay contact means KX4 is turned on, and a count completion signal CUC is provided through the inverters I67 and I69. This signal CUC is applied through a NAND circuit ND4 to the flip-flop FF1 to reset the latter. Thus, the coin counting operation is completed.

Incidentally, if, while coins are being stacked in the stacking cylinder with the vibrating mechanism being operated, a coin-standing condition is detected, i.e. a coin is detected as standing on edge in the stacking cylinder, the coin-standing detection switch SW13 is turned on. The term "coin-standing" herein used is intended to mean that a coin stands upright and is not stacked flat in the stacking cylinder 21. This coin-standing can be detected by utilizing the conductivity of the coins.

When the switch SW13 is thus turned on, an "L" level signal is applied to a NAND circuit ND15 through inverter I68 and I70, and therefore no packaging start signal RWS is produced by the NAND circuit ND15. On the other hand, an "H" level signal from the inverter I68 is applied to a NAND circuit ND16, from which a coin-standing signal TUB is produced under the conditions of the packaging mode, and so forth. This coin-standing signal TUB is applied to the terminal $A_2$ of the mono-multivibrator MM4, from the terminal Q of which an "L" level signal is provided, whereby the keep relay X4 is reset.

The coin-standing signal TUB is applied to the terminal $A_2$ of the mono-multivibrator MM3. Based on the output provided at the terminal Q of the mono-multivibrator MM3, the shutter opening SDS is produced to open the shutter 22. This "Q" output of the mono-multiplier MM3 is applied to the NOR circuit NO28 through the inverter I48, and the solenoid drive signal SND is produced from the inverter I51 to drive a solenoid (not shown) arranged at the outlet 34. As a result, the outlet 34 is moved so that the group of coins including the coin standing upright fall through outlet 34 and are directed into a container separately provided.

Then, when the shutter 22 is closed, the automatic count start switch SW2 is turned off to issue the automatic count start command.

On the other hand, detection switches SW6 and SW7 are provided with respect to the arms 32 described before, so as to detect the number of coins to be packaged in response to the vertical movement of the arms 32. If the number of stacked coins is more than the predetermined number of coins of a preselected denomination, the distance between the arms 32 is longer than a predetermined distance; while if the number of stacked coins is less, the distance is shorter. The on-off operations of the switches SW6 and SW7 are controlled by this change of the distance between the arms 32, and therefore it can be detected whether or not the number of coins is acceptable.

In the case when the number of stacked coins is not acceptable or is not equal to the predetermined number, both switches SW6 and SW7 are turned on, and an "H" level signal is produced by an inverter I21. Therefore, a flip-flop FF6 is set, whereby the solenoid drive signal SND is produced. Thus, the stack of coins the number of which is less than or more than the predetermined number is rejected.

A stop push button switch PB3 is provided so that whenever trouble occurs during the operation in the count mode or in the packaging mode, all of the mechanisms of the coin packaging machine are stopped by depressing it. A manual push button switch PB4 is provided to carry out inching operation of the packaging section. A clear push button switch PB2 is employed to restore the entire machine to its standby conditions.

An alarm signal ALA is produced in the cases where (1) the coin guide cover is opened, (2) the front door is opened during a coin packaging operation, (3) the count section is not at its standby position although the clear operation has been conducted, and (4) denominations are not coincident in the packaging mode. In these cases, a lamp is lighted with the aid of the alarm signal ALA. Another alarm signal ALB is produced in the cases where (1) the packaging section is over-loaded, (2) an excess or shortage in the number of coins is detected when both lateral edge portions of the paper have been crimped and (3) a period of time required for packaging a stack of coins has exceeded a predetermined period of time.

Figure 8:
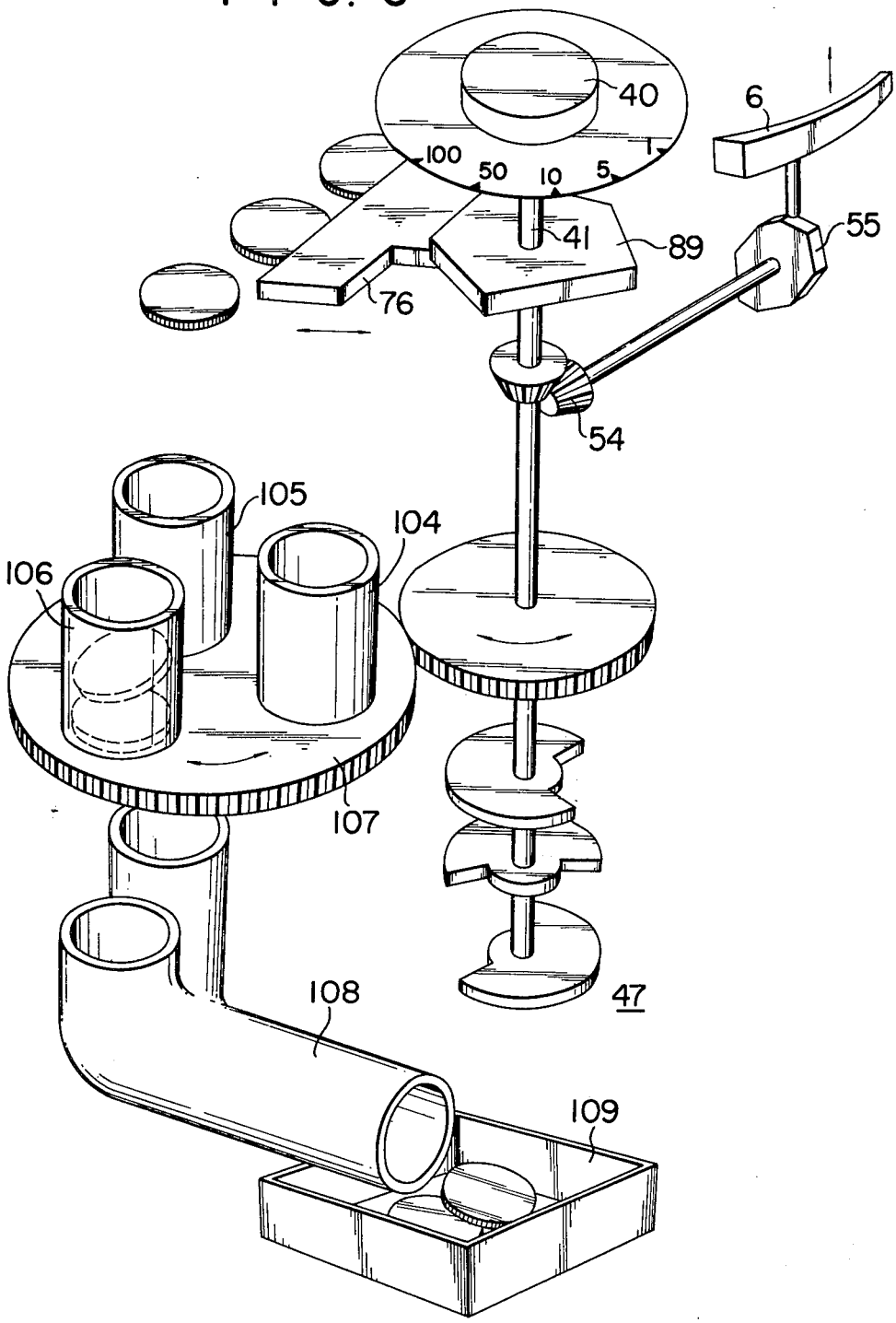
FIG. 8 is a perspective view illustrating another example of this invention.

In the above-described embodiment, as illustrated in FIGS. 1 and 2, the diameter of the stacking cylinder 21 is mechanically controlled in response to a preselected denomination. However, this arrangement may be modified as follows: As shown in FIG. 8, stacking cylinders 104, 105 and 108 are provided separately according to coin denominations on a disk 107 operated by the above-described knob 40, and for instance the stacking cylinder 104 is designed so as to be vertically divided into two parts, so that the coins stacked in the stacking cylinder 104 are conveyed to the packaging section provided by it.

In this case, if another denomination is selected by the knob 40, the coins previously stacked to be packaged are rejected into a container 109 through a coin rejecting pipe 108 below the disk 107, and held therein. When a coin-standing condition is detected, the coin removal pipe 108 is moved to remove the coins. In this example, the number of the stacking cylinders are three, that is, three different stacking cylinders are provided respectively for three different denominations; however, it should be noted that the invention is not limited thereto. Furthermore, the invention has been described with reference to the case where the number of a given denomination of coins to be packaged is always the same, that is, pacakges of only one kind are provided for coins of a given denomination; however, coins of a given denomination can be wrapped into packages of several different numbers of coins.

I claim:

1. A coin packaging machine for packaging different kinds of packages each containing a preselected number of coins of a preselected denominations, which comprises:

a kind of package selecting means of selectively specifying the kind of packages to be packaged;

at least one stacking cylinder for stacking coins received therein;

packaging means for receiving coins stacked in said stacking cylinder and wrapping the stack of coins with packaging paper and discharging the wrapped stack of coins through discharge path;

a paper feeding section for feeding packaging paper to said packaging means;

coin conveying means for conveying coins to be packaged to said stacking cylinder;

coin counting means operatively associated with said coin conveying means for counting the number of coins conveyed by said coin conveying means;

control and drive means connected to said kind of package selecting means, said packaging means, said paper feeding section, said coin conveying means and said coin counting means for conveying and counting coins and stacking and wrapping the conveyed and counted coins in accordance with the kind of package selected by said kind of package selecting means; and removing means connected to said kind of package selecting means and operatively associated with said stacking cylinder and said packaging means for removing any wrapped package of coins from said packaging means and for removing any coins left in said stacking cylinder through said discharge path when said kind of package selected means is actuated to change the kind of package to be packaged.

2. A machine as claimed in claim 1 in which said packaging means is directly beneath said stacking cylinder and said stacking cylinder comprises means for mechanically controlling the diameter thereof and connected to said kind of pacakge selecting means for controlling the diameter in response to a kind of package selected by said kind of package selecting means, and coin holding means for holding coins being stacked in said stacking cylinder until they are to be conveyed to the packaging means, and said removing means comprises means connected to said coin holding means for actuating said coin holding means when a different kind of package is designated by said kind of package selecting means for releasing undesired coins left in said stacking cylinder to fall through said packaging means and be removed through said discharge path for said packaging means.

3. A machine as claimed in claim 1 in which said control and drive means further comprises means for automatically restoring said coin packaging machine to its start condition when said kind of package selecting means is actuated to select a different kind of packageto be packaged.

4. A coin packaging machine for packaging different kinds of packages each containing a preselected number of coins of a preselected denomination, which comprises:

a kind of package selecting means for selectively specifying the kind of packages to be packaged;

a plurality of stacking cylinders respectively having sizes according to the different denominations of coins in the different kinds of packages and a disk on which said cylinders are mounted in said machine for movement of said cylinders in the plane of said disk;

packaging means for receiving coins stacked in respective stacking cylinders and wrapping the stack of coins with packaging paper and discharging the wrapped stack of coins through a dischage path;

a paper feeding section for feeding packaging paper to said packaging means;

coin conveying means for conveying coins to be packaged to said stacking cylinders;

coin counting means operatively associated with said coin conveying means for counting the number of coins conveyed by said coin conveying means;

control and drive means connected to said kind of package selecting means, said disk, said packaging means, said paper feeding section, said coin conveying means and said coin counting means for conveying and counting coins and stacking and wrapping the conveyed and counted coins in accordance with the kind of package selected by said kind of package selecting means; and removing means connected to said kind of package selecting means and operatively associated with said disk and said packaging means for removing any wrapped package of coins from said packaging means and for moving said disk to discharge any coins left in a stacking cylinder being used on said disk through said disk when said kind of pacakge selecting means is actuated to change the kind of package to be packaged, and collecting means beneath said disk for receiving the coins from the stacking cylinder.

* * * * *